US006367560B1

(12) United States Patent
de Ris et al.

(10) Patent No.: US 6,367,560 B1
(45) **Date of Patent: *Apr. 9, 2002**

(54) WET SPRINKLER SYSTEM FOR COLD ENVIRONMENTS

(75) Inventors: John L. de Ris, Foxborough; Joseph Hankins, Norfolk, both of MA (US); Wayne H. Wilke, Stilwell, KS (US)

(73) Assignee: Factory Mutual Research Corp., Norwood, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/559,101

(22) Filed: Apr. 27, 2000

Related U.S. Application Data

(60) Provisional application No. 60/138,533, filed on Jun. 10, 1999, and provisional application No. 60/131,847, filed on Apr. 30, 1999.

(51) Int. Cl.[7] ..... A62C 2/00

(52) U.S. Cl. ..... 169/43; 169/47; 169/16; 169/14

(58) Field of Search ..... 169/43, 44, 46, 169/47, 16, 14, 37; 239/208, 209; 252/2–7

(56) References Cited

U.S. PATENT DOCUMENTS

| | | | | |
|---|---|---|---|---|
| 2,713,916 A | | 7/1955 | Muckenfuss | |
| 3,702,636 A | * | 11/1972 | Hart | 169/16 |
| 6,006,840 A | * | 11/1972 | Sundholm | 169/14 |
| 4,177,862 A | | 12/1979 | Bray | |
| 4,756,839 A | | 7/1988 | Curzon | |
| 5,845,716 A | * | 12/1998 | Birk | 169/43 |
| 5,934,380 A | | 8/1999 | Finnerty | |

FOREIGN PATENT DOCUMENTS

| | | |
|---|---|---|
| JP | 7-171228 | 7/1995 |
| WO | WO 99/24120 | 5/1999 |

OTHER PUBLICATIONS

Finnerty et al., "Water–Based Halon replacement Sprays," U.S. Army Research Laboratory, ARL–TR–1138, Jul. 1996.

* cited by examiner

*Primary Examiner*—Lisa Ann Douglas
(74) *Attorney, Agent, or Firm*—Richard L. Aitken; Venable

(57) ABSTRACT

In a sprinkler system for warehouse freezers or other cold environments, a sprinkler system piping connected to a water supply through a check valve and extends through a freezing cold environment to sprinkler heads positioned to discharge extinguishant. The sprinkler system piping within the cold environment is filled with a solution of potassium lactate. When a fire occurs causing one or more of the sprinkler heads to be activated, the sprinkler heads will discharge the potassium lactate onto the fire. This action will reduce the pressure in the sprinkler system piping bellow that of the water supply so that water flows from the water supply through the sprinkler system piping through the activated sprinkler heads to be discharged upon the fire.

20 Claims, 1 Drawing Sheet

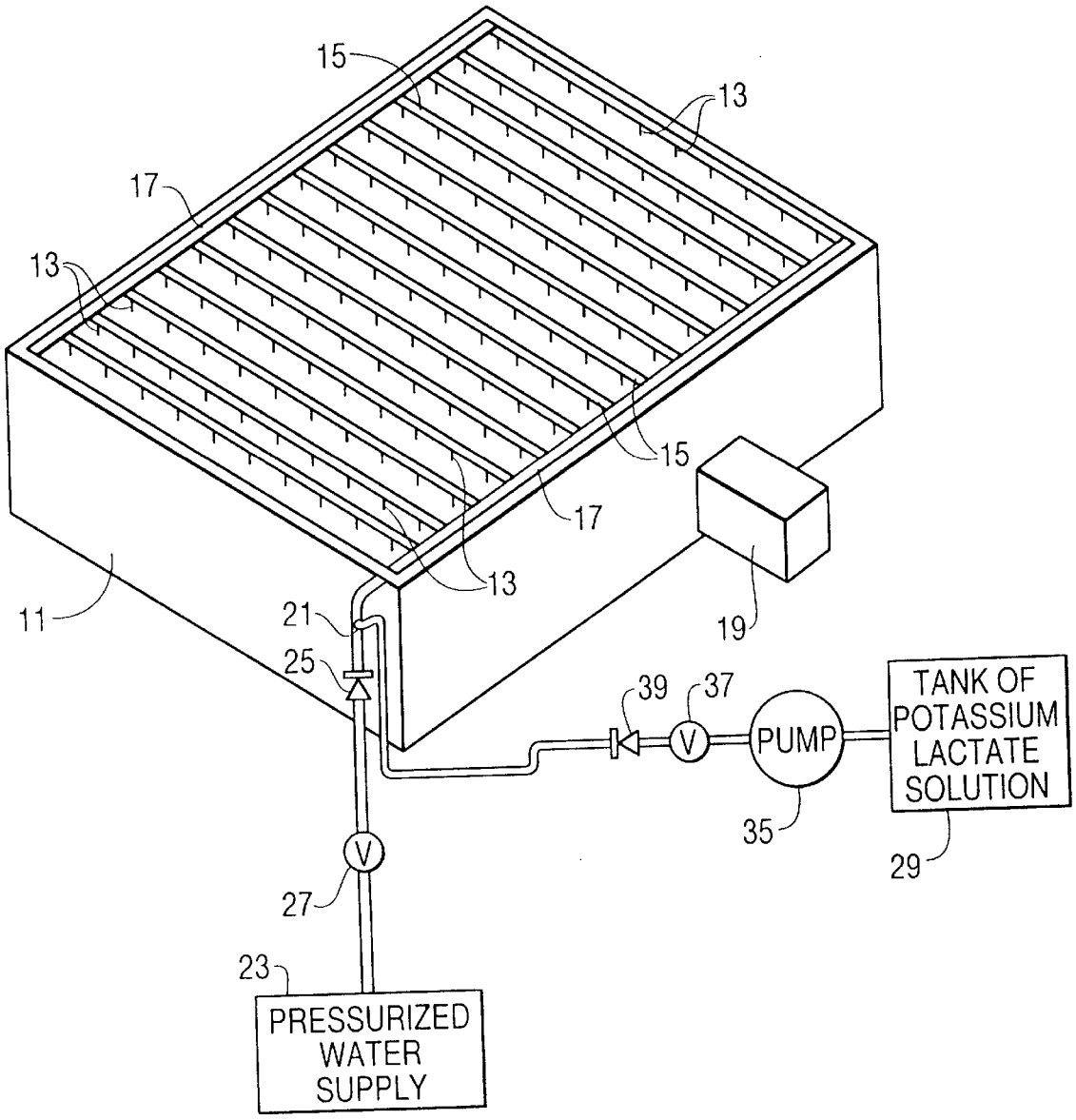
15
13
17
13
15
17
13
11
21
25
19
39
37
V
PUMP
TANK OF POTASSIUM LACTATE SOLUTION
35
29
V
27
23
PRESSURIZED WATER SUPPLY

WET SPRINKLER SYSTEM FOR COLD ENVIRONMENTS

This invention claims the benefit of provisional application No. 60/138,533, filed Jun. 10, 1999, and No. 60/131,847, filed Apr. 30, 1999.

This invention relates to sprinkler systems and, more particularly, to a fire extinguishant sprinkler system designed to operate in freezers and other cold environments.

BACKGROUND OF THE INVENTION

Sprinkler systems for extinguishing fires in large storage freezers and in other cold environments at freezing temperatures wherein the piping leading to the sprinkler heads extend through the freezing environment have to be designed in a way to prevent extinguishant in the piping from freezing. One way to accomplish this objective is to use a dry pipe system wherein the piping in the freezing environment leading from a water supply under pressure is maintained dry and filled with air or other gas. When a sprinkler head is activated in response to a fire beneath the sprinkler head, water must travel from the source of supply through the piping to sprinkler head before the water is sprayed onto the fire. As a result, an unacceptably long delay between the time the sprinkler head is activated and the time that the sprinkler head begins to discharge water occurs and the desired early suppression fast response for large storage systems is not achieved. In some wet pipe systems for freezing environments, propylene glycol is used to fill the piping leading to the sprinkler heads, but when propylene glycol is used in concentrations sufficient to prevent freezing, the solution is flammable and, therefore, its effectiveness in a sprinkler system is substantially compromised. A calcium chloride solution would prevent freezing, but it is corrosive and thus would increase the property damage when the sprinkler system is activated. Other solutions that might be used in a wet pipe sprinkler system are glycerine, methanol, potassium acetate and urea. However, each of these solutions raise concern from a combustibility, corrosivity and/or environmental safety standpoint. Accordingly, there is a need for an effective early suppression, quick response, sprinkler system for freezers and other cold environments in which the piping leading the sprinkler heads passes through low temperature environments substantially below the freezing point of water.

SUMMARY OF THE INVENTION

In accordance with the present invention, a sprinkler system for use in freezers and other cold environments is provided wherein the piping passing through the low temperature environment is filled with a selected solution of potassium lactate. The piping is connected to a conventional water supply under pressure through a check valve. The pressure of the potassium lactate solution in the piping is maintained above the water pressure in the source of water supply so the check valve remains closed when no sprinklers have been activated. The concentration of the potassium lactate in the aqueous solution is selected to be high enough to prevent the solution from freezing in the sprinkler system piping and yet low enough to prevent the viscosity of the solution from interfering with the flow rate in standard sprinkler system piping. For any practical application, the concentration of potassium lactate should be between 30% and 60% by weight. For freezer and cold environments at 10° F., a potassium lactate concentration of 30% by weight can be used. For most applications, the concentration of the potassium lactate should be between 40 and 50 percent by weight. For freezers and cold environments at temperatures between 16° F and 0° F., a 40% solution by weight of potassium lactate is used. For sharp freezers wherein the temperature is maintained between 0° and −20° F., a 47% solution by weight of potassium lactate is preferably used. In the system, a tank containing the potassium lactate solution is connected to the piping and a jockey pump is provided to pump an additional volume of potassium lactate into the piping to provide a make up for potassium lactate lost from the piping due to leakage and to maintain the pressure in the piping above that of the source of water supply.

When the sprinkler head is actuated, the potassium lactate in the piping leading to the sprinkler head will be sprayed from the sprinkler head reducing the pressure in the piping below the pressure in the water supply and the check valve between the water supply and the sprinkler system piping will open. Water will then flow from the water supply through the piping to the actuated sprinkler head.

Potassium lactate in the right concentration is highly suitable to be used in the sprinkler system piping because it is not flammable, is not corrosive, is nontoxic and is environmentally safe. In fact, potassium lactate is edible and is frequently used as a food additive. It is also effective as a fire extinguishant.

BRIEF DESCRIPTION OF THE DRAWING

The single FIGURE of the drawings schematically illustrates the sprinkler system in a warehouse type freezer.

DESCRIPTION OF THE PREFERRED EMBODIMENT

As shown in FIG. 1, a warehouse-type freezer enclosure 11 (shown with the roof removed) is provided with an overhead sprinkler system comprising sprinkler heads 13 which are connected to and mounted on branch lines 15, three inches in diameter, extending between cross mains 17, six inches in diameter. The sprinkler heads 13 are distributed uniformly over the ceiling of the freezer enclosure 11. A refrigeration unit 19 will maintain the temperature within the enclosure 11 at a freezing temperature. In a conventional freezer, the refrigeration unit will maintain a temperature between 0° and 16° and in a sharp freezer, will maintain the temperature between −20° and 0° F. One of the cross mains 17 is connected to an 8 inch riser which connects the piping within the freezer to a pressurized water supply 23 through a check valve 25 and a gate valve 27. The sprinkler system piping comprising the cross mains 17 and the branch lines 15 are filled with a solution of potassium lactate and water maintained at a pressure above the pressure of the pressurized water supply 23. In operation, the gate valve 27 will be open and the check valve 25 will be maintained closed by the pressure downstream from the check valve 25 being greater than the pressure provided by the water supply 23 upstream from the check valve 25.

When a fire occurs within the enclosure 17, one or more of the sprinkler heads over the fire will be activated and begin to discharge the potassium lactate solution onto the fire. The potassium lactate within the piping near the actuated sprinkler heads will be quickly exhausted and the flow through the piping to the activated sprinkler heads will reduce the pressure downstream from the check valve 25 causing it to open allowing water to flow from the pressurized water supply 23 through the riser 21 and the piping 15 and 17 to the activated sprinkler heads whereby water will be discharged through the activated sprinkler heads onto the fire. Because the water will be flowing through the piping system at a relevantly high rate, the water will not freeze within the piping 15 and 17 even though the temperature within the enclosure 11 remains at a freezing temperature To provide makeup for leakage of potassium lactate from the piping 15 and 17, a tank 29 containing the potassium lactate solution is provided. Potassium lactate is supplied from the tank 29 to the riser 21 by means of a jockey pump 35 which provides makeup potassium lactate to the piping 15 and 17 through a gate valve 37, a check valve 39 and the riser 21. In operation, the gate valve 37 will be open and the check valve 39 will be maintained closed by back pressure from the sprinkler piping. When leakage of potassium lactate occurs from the sprinkler system, the leaked potassium lactate is replaced by potassium lactate from the tank 29 by the jockey pump to maintain the pressure in the pipes 15 and 17 above the pressure of the water pressure supply 23. The jockey pump lacks capacity to maintain the pressure in the sprinkler system piping above the pressure of the water supply when a sprinkler head is activated.

As the concentration of potassium lactate increases, the viscosity of the solution increases causing the flow rate in the sprinkler system piping to decrease. With a solution with a concentration of potassium lactate of 40% by weight, the size of the sprinkler piping must be increased by about 10% to achieve the same flow rate as water. For a solution of potassium lactate solution with a concentration of 47% by weight, the size of the piping must be increased by about 20% to achieve the same flow rate as water. For solution of potassium lactate with a concentration of 60% by weight, the size of the piping must be increased by about 50% to achieve the same flow rate as water. As the size of the piping is increased, the cost of the sprinkler system increases. Accordingly, the concentration of the potassium lactate should be selected to be great enough to prevent freezing in the environment in which the sprinkler system is to be used and then the piping size should be selected to achieve the desired flow rate to activated sprinklers so as to achieve the desired early suppression fast response when a fire occurs.

In most applications in which the temperature of the freezer or other cold environment is above −20° F., the concentration of the potassium lactate by weight should be 40 to 50%.

In a preferred embodiment for freezers maintaining a temperature between 0° and 16° F., the preferred concentration of potassium lactate is 40% by weight in the potassium lactate solution. For sharp freezers, the temperature is maintained between 0° and −20° F., the preferred concentration of potassium lactate in the solution is 47% by weight. For very cold environments or freezers in which temperatures of −60° F. occur, the concentrations should be 60% by weight. If the sprinkler piping is subjected to temperatures of only 10° F. or higher, the concentrations of potassium lactate should be 30% by weight.

The above described specific embodiment of the invention is implemented in a freezer warehouse facility. The invention can also be used in other cold environments, such as in an outdoor loading dock which is exposed to cold environmental temperatures during winter, or anywhere in which the sprinkler piping is subjected to sufficiently cold temperatures to cause destructive freezing of stationary water in the sprinkler piping.

The above description is of preferred embodiments of the invention and modification may be made thereto without departing from the spirit and scope of the invention which is defined in the appended claims.

What is claimed is:

1. A method of extinguishing a fire in a below freezing environment comprising connecting a source of extinguishant under pressure to sprinkler heads through piping extending through said below freezing environment, said piping including one or more conduits extending horizontally in said cold environment between a plurality of said sprinkler heads, filling said piping including said conduits with a solution consisting essentially of potassium lactate and water prior to activating said sprinkler heads, activating said sprinkler heads to discharge potassium lactate solution from said piping through said sprinkler heads on said fire.

2. A method as recited in claim 1, wherein the concentration of potassium lactate in said solution is between 30 and 60% by weight.

3. A method as recited in claim 1, wherein the concentration of potassium lactate in said solution is between 40 and 50% by weight.

4. A method as recited in claim 1, wherein said below freezing environment is within a freezer.

5. A method as recited in claim 4, wherein the temperature within said freezer is maintained between 0 and −20° F. and wherein the concentration of potassium lactate in said solution is about 47% by weight.

6. A method as recited in claim 4, wherein the temperature in said freezer is maintained between 16° F. and 0° F. and wherein the concentration of potassium lactate in said solution is about 40% by weight.

7. A method as recited in claim 1, wherein said source of extinguishant is connected to said sprinkler heads through a check valve, and further comprising maintaining the pressure in said piping above the pressure in said source of extinguishant to maintain said check valve closed when said sprinkler heads are not activated, reducing the pressure in said piping when one of said sprinkler heads is activated below the pressure of said source of extinguishant to cause extinguishant to flow from said source of extinguishant into said piping and through said one of said sprinkler heads onto said fire.

8. A method as recited in claim 7, wherein said source of extinguishant comprises a source of water.

9. A method as recited in claim 7, further comprising supplying said solution of potassium lactate to said piping by means of a jockey pump to provide make-up for leakage of potassium lactate solution from said piping and to maintain the pressure in said piping above said pressure in said source of extinguishant when leakage occurs.

10. A method as recited in claim 1, wherein said source of extinguishant is water.

11. A system for extinguishing fires in a cold environment below the freezing temperature of water comprising an array of sprinkler heads operable to discharge fluid, a source of extinguishant under pressure, piping extending through said cold environment between said sprinkler heads and said source of extinguishant, said piping including one or more conduits extending horizontally in said cold environment between a plurality of sprinkler heads, said piping, including said conduits, being filled with a solution consisting essentially of potassium lactate and water prior to activation of said sprinkler heads, said sprinkler heads being activated responsive to the occurrence of a fire in said cold environment and adapted when activated to discharge liquid contained in said piping on said fire.

12. A system for extinguishing fires as recited in claim 11, wherein the concentration of potassium lactate in said solution is 30 to 60% by weight.

13. A system for extinguishing fires as recited in claim 11, wherein the concentration of potassium lactate in said solution is 40 to 50% by weight.

14. A system for extinguishing fires as recited in claim 11, wherein said sprinkler heads are disposed in a freezer and said piping extends from said source of extinguishant through said freezer.

15. A system as recited in claim 14, wherein said freezer maintains the temperature between 0 and −20° F. and wherein the concentration of potassium lactate in said solution is about 47% by weight.

16. A system as recited in claim 14, wherein said freezer maintains a temperature of between 0° F. and 16° F. and the concentration of said potassium lactate in said solution is about 40% by weight.

17. A system as recited in claim 11, further comprising a check valve between said source of extinguishant and said piping to permit flow from said source of extinguishant into said piping when the pressure in said source of extinguishant is greater than the pressure in said piping.

18. A system as recited in claim 17, wherein said source of extinguishant comprises a source of water.

19. A system as recited is claim 16, further comprising a tank containing said potassium lactate solution, and a pump connected to supply said potassium lactate solution from said tank to said piping to maintain the pressure in said piping at a pressure greater than the pressure in said source of extinguishant when said sprinkler heads are not activated.

20. A system as recited in claim 17, wherein said piping comprises cross mains and branch lines in a railroad track array wherein one of said mains is connected to said source of extinguishant through said check valve and said branch lines extend between said cross mains, said sprinkler heads being connected to said branch lines.

* * * * *